United States Patent [19]

Tsuchihashi et al.

[11] 4,340,844

[45] Jul. 20, 1982

[54] LIGHTING EQUIPMENT

[75] Inventors: Michihiro Tsuchihashi; Masato Saito; Keiichi Baba; Yusaku Matsushima, all of Kamakura, Japan

[73] Assignee: Mitsubishi Denki Kabushiki Kaisha, Tokyo, Japan

[21] Appl. No.: 19,931

[22] Filed: Mar. 12, 1979

[30] Foreign Application Priority Data

Mar. 10, 1978 [JP] Japan ..... 53-28122

[51] Int. Cl.[3] ..... H05B 41/16

[52] U.S. Cl. ..... 315/283; 315/246; 315/DIG. 5

[58] Field of Search ..... 315/246, 283, 358, DIG. 5; 313/184, 229

[56] References Cited

FOREIGN PATENT DOCUMENTS 493360 10/1938 United Kingdom ..... 313/184

1466215 3/1977 United Kingdom ..... 315/244

OTHER PUBLICATIONS

Elenbaas, *High Pressure Mercury Vapour Lamps and Their Applications,* Philips Technical Library, Netherlands, 1965 pp. 82–85.

*Primary Examiner*—Eugene R. La Roche

*Attorney, Agent, or Firm*—Oblon, Fisher, Spivak, McClelland & Maier

[57] ABSTRACT

A lighting equipment comprises a high pressure metal vapor discharge lamp having a lamp voltage of 145 to 180 V actuated by a lag type ballast supplied with a voltage of lower than 220 V or a high pressure metal vapor discharge lamp having a lamp voltage of 150 to 200 V actuated by a lag type ballast supplied with a voltage of higher than 220 V whereby a consumed power is reduced in comparison with the conventional lighting device.

2 Claims, 3 Drawing Figures

LIGHTING EQUIPMENT

FIELD OF THE INVENTION

The present invention relates to a lighting device using a high pressure metal vapor discharge lamp actuated by a lag type ballast.

BACKGROUND OF THE INVENTION

High pressure metal vapor discharge lamps such as high pressure mercury vapor discharge lamp have been used for various usages for interior and exterior lighting. However, from the viewpoints of necessity of saving of energy, the power savings have been considered to turn off certain percentages of lamps in comparison with the lighting lamps in past. Such thinned-out lighting causes an irregular intensity of illumination whereby a trouble may be disadvantageously caused in workings and it is not preferable in practice.

In order to save power for lighting, the uses of lamps having higher efficiency can be considered. However, in such case, a construction for exchanging the lighting devices required is costly. Even though construction for the new lighting equipment is not required and only lamps are exchanged, needless intensity of illumination may be given or coloring of the new lamps may be remarkably different whereby a trouble may be caused in workings.

SUMMARY OF THE INVENTION

It is an object of the present invention to provide a lighting equipment for saving lighting power without changing kind of a lamp by actuating a high pressure metal vapor discharge lamp having higher lamp voltage by a lag type ballast.

In accordance with the present invention, the lamp can be fitted to the same conventional lighting fixture for similar lamp in order to turn on the new lamp whereby the consumed power of the lighting equipment can be easily saved without troubles of the irregular intensity of illumination caused by thinned-out lighting or different coloring of the lamp. The luminous efficiency of the lamp is the same or is improved depending upon the reduction of the consumed power of the ballast in comparison with the conventional one.

It is another object of the present invention to prolong a life of the lamp in the case of using the same type lamp, since a load for the lamp is reduced depending upon the reduction of the lamp power.

It is the other object of the present invention to prolong a life of a ballast itself since a consumed power of the ballast is reduced in the case actuating the lamp.

DESCRIPTION OF THE PREFERABLE EMBODIMENTS

Figure 1:
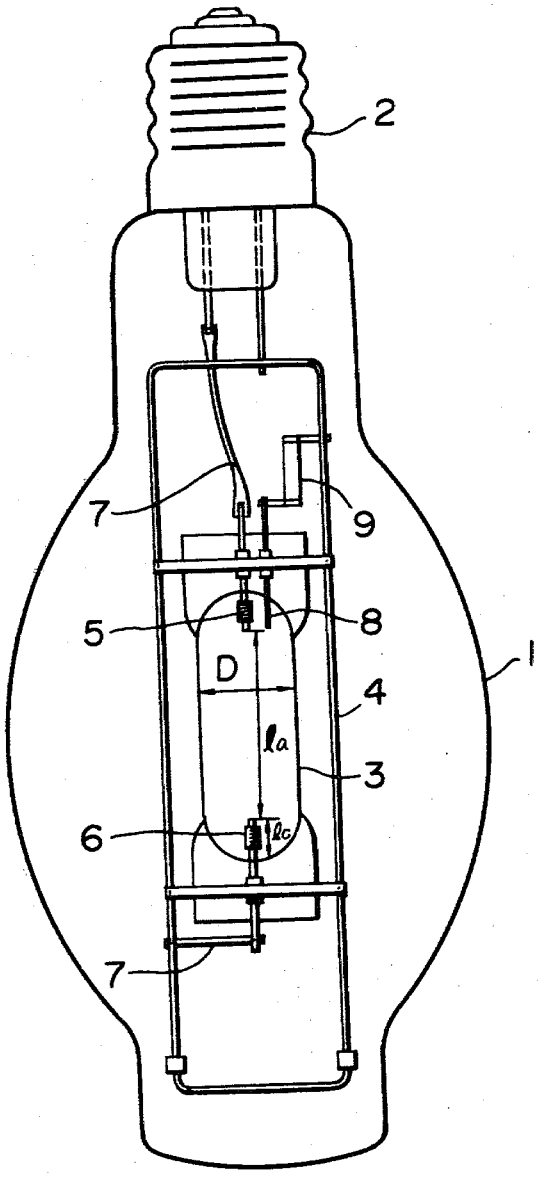
FIG. 1 is a front view of a high pressure mercury vapor discharge lamp.

FIG. 1 is a front view of a high pressure mercury vapor discharge lamp used in the present invention. In FIG. 1, the reference numeral (1) designates an outer tube made of light transmiscible glass having egg shape which equips a base (2) at one edge; (3) designates an arc tube which is held and fixed in the outer tube by a supporting wire (4) and in which mercury and rare gas are filled and which is a cylindrical quartz tube; (5) and (6) designate respectively electrodes which are electrically connected to each base (2) through the supporting wire (4) or a ribbon lead (7) and which are seal-bonded at each of both edge of the arc tube (3); (8) designates a starting auxiliary electrode seal-bonded near the electrode (5); and (9) designates a starting resistance.

Figure 2:
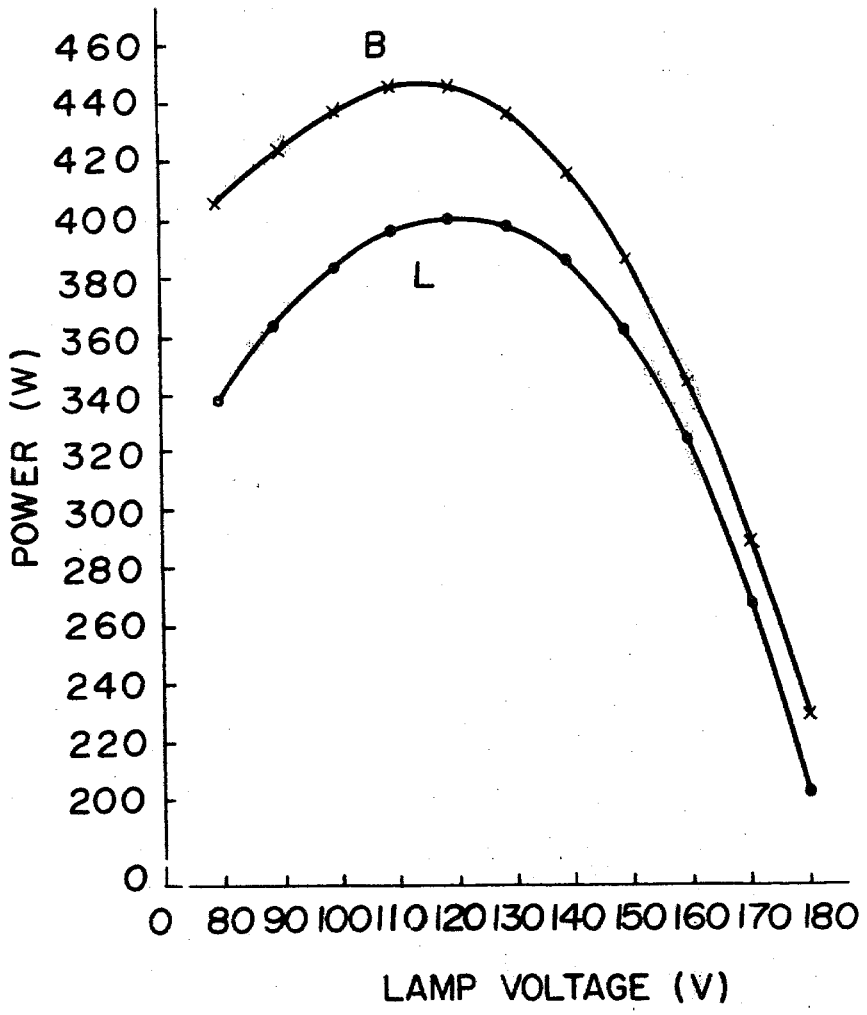
FIG. 2 is a characteristic diagram of powers of 400 W high pressure mercury vapor discharge lamps having various lamp voltages actuated by a 200 V lag type ballast.

FIG. 2 is a characteristic diagram for illustrating the principle of the present invention. 400 W high pressure mercury vapor discharge lamps having various lamp voltages which have the structure of FIG. 1 are prepared and these discharge lamps are actuated by a 200 V lag type ballast and lamp voltages. Lamp powers and ballast input powers are measured and the characteristic curves are shown in FIG. 2 wherein the curve L shows the lamp powers and the curve B shows the ballast input powers.

As it is clear from FIG. 2, the lamp power L and the ballast input power B are increased depending upon the increase of the lamp voltage. The lamp power L and the ballast input power B are maximum at the lamp voltage of about 120 V and they are decreased by increasing the lamp voltage over 120 V.

In the 400 W conventional fluorescent high pressure mercury vapor discharge lamp, the rated lamp voltage was 130 V. As it is shown in FIG. 2, the lamp power L was 397 W and the ballast input power B was 436 W. The consumed power of the ballast was a difference between the ballast input power B and the lamp power L and it is 39 W (=436 W−397 W) at the rated lamp voltage of 130 V.

When the lamp voltage is higher than the rated lamp voltage of 130 V for the conventional high pressure mercury vapor discharge lamp, ballast input powers, ballast input power reduced percents, lamp powers, lamp power reduced percents and ballast consumed powers were measured. The results are shown in Table 1.

TABLE 1

| | Input side | | Lamp side | | |
|---|---|---|---|---|---|
| Lamp voltage (V) | Ballast input power (W) | Ballast input power reduced percent (%) | Lamp power (W) | Lamp power reduced percent (%) | Ballast consumed power (W) |
| 130 | 436 | 0 | 397 | 0 | 39 |
| 140 | 416 | 5 | 384 | 3 | 32 |
| 145 | 401 | 8 | 373 | 6 | 28 |
| 150 | 384 | 12 | 361 | 9 | 23 |
| 160 | 340 | 21 | 322 | 19 | 18 |
| 170 | 278 | 33 | 266 | 33 | 12 |

As it is clear from Table 1 and FIG. 2, the ballast input power and the lamp power are remarkably decreased and the ballast consumed power is also decreased depending upon the increase of the lamp voltage.

The 400 W conventional high pressure mercury vapor discharge lamp has a rated lamp voltage of 130 V, however the discharge lamps having a lamp voltage of about 120 to 140 V have been used from the viewpoint of quality control in a production.

In the invention, high pressure mercury vapor discharge lamps having a lamp voltage of higher than 145 V and lower than 180 V are used in order to attain power saving effects from various viewpoints.

When the lamp voltage is lower than 145 V, satisfactory power saving effect could not be obtained whereas when the lamp voltage is higher than 180 V, the voltage applied to the lamp is similar to the lamp voltage whereby the discharge becomes unstable to cause easily extinction of the lamp. Therefore, in order to obtain excellent power saving effect and to maintain stable discharge, the range of the lamp voltage in the invention is in the range of 145 to 180 V, preferably 150 to 170 V.

The ballast used in the present invention is a lag type ballast called a choke type. When a lead type ballast or a constant wattage type ballast arc tube is used, a lamp power is increased depending upon an increase of a lamp voltage whereby the result of the present invention is not attained.

The present invention will be further illustrated by certain examples and references which are provided for purposes of illustration only and are not intended to be limiting the present invention.

EXAMPLE 1

Arc tube (3)

Inner diameter D: 1.95 cm;

Separation between electrodes (6),(7) 1*a*: 6 cm;

Separation between edge of electrode (6),(7) to sealing edge 1*c*: 1.2 cm;

Wall loading 6.6 W/cm$^2$;

Suitable amounts of argon (for starting) and mercury were filled to be a designed lamp voltage of 150 V.

The arc tube (3) was held in an outer tube (1) in which nitrogen was filled at 100 Torr and on inner wall of which a phosphor layer was formed to prepare a 400 L W fluorescent high pressure mercury vapor discharge lamp.

The fluorescent high pressure mercury vapor discharge lamp was actuated by a 200 V lag type ballaster for 400 W high pressure mercury vapor discharge lamp whereby all of mercury in the arc tube (3) was vaporized to give a lamp voltage of 150 V and the lamp power was 361 W.

The lamp power reduced percent was $9.1\% = (397-361)/397 \times 100\%$.

The lamp power of 9.1% could be reduced by actuating the fluorescent high pressure mercury vapor discharge lamp with 200 V lag type ballaster for 400 W.

A total luminous flux of the fluorescent high pressure mercury vapor discharge lamp was 21,700 lm. which was substantially the same with the total luminous flux of the 400 W conventional fluorescent high pressure mercury vapor discharge lamp of 23800 lm. The combined efficiency (Total luminous flux/ballast input power) was improved for 5.3% in comparison with that of the 400 W conventional fluorescent high pressure mercury vapor discharge lamp. (hereinafter, the fluorescent high pressure mercury vapor discharge lamp is referred to as discharge lamp).

EXAMPLE 2

Arc tube (3)

Inner diameter D: 1.55 cm

Separation between electrodes (6),(7) 1*a*: 5 cm

Separation between edge of electrode (6),(7) to sealing edge 1*c*: 1.0 cm;

Wall loading: 6.2 W/cm$^2$

Suitable amounts of argon (for starting) and mercury were filled to be a designed lamp voltage of 150 V.

The arc tube (3) was held in an outer tube (1) in which nitrogen gas was filled at 100 Torr and on an inner wall of which a phosphor layer was formed to prepare a 250 W fluorescent high pressure mercury vapor discharge lamp.

The discharge lamp was actuated by a 200 V lag type ballast for 250 W discharge lamp whereby all of mercury in the arc lamp was vaporized to give a lamp voltage of 150 V and a lamp power was 230 W.

The lamp power reduced percent was $6.9\% = (247-230)/247 \times 100\%$.

The lamp power of 6.9% could be reduced by actuating the discharge lamp with the 200 V lag type ballast for 250 W.

A total luminous flux of the discharge lamp was 13100 lm which was substantially the same with the total luminous flux of the 250 W conventional discharge lamp of 13700 lm. The combined efficiency was improved for 6.9% in comparison with the 250 W conventional discharge lamp.

EXAMPLE 3

Arc tube (3)

Inner diameter D: 1.75 cm;

Separation between electrodes (6),(7) 1*a*: 5.5 cm;

Separation between edge of electrodes (6),(7) to sealing edge 1*c*: 1.0 cm;

Wall loading: 6.4 W/cm$^2$;

Suitable amounts of argon (for starting) and mercury were filled to be a designed lamp voltage of 150 V.

The arc tube (3) was held in an outer tube (1) in which nitrogen gas was filled at 100 Torr and on an inner wall of which a phosphor layer was formed to prepare a 300 W fluorescent high pressure mercury vapor discharge lamp.

The discharge lamp was actuated by a 200 V lag type ballast for 300 W discharge lamp whereby all of mercury in the arc lamp was vaporized to give a lamp voltage of 150 V and a lamp power was 276 W.

The lamp power reduced factor was $6.8\% = (296-276)/296 \times 100\%$.

The lamp power of 6.8% could be reduced by actuating the discharge lamp with the 200 V lag type ballast for 300 W.

A total luminous flux of the discharge lamp was 16,000 lm which was substantially the same with the total luminous flux of the 300 W conventional discharge lamp of 17,100 lm. The combined efficiency was improved for 4.6% in comparison with the 300 W conventional discharge lamp.

EXAMPLE 4

Arc tube (3)

Inner diameter D: 2.25 cm;

Separation between electrodes (6),(7) 1*a*: 10 cm;

Separation between edge of electrodes (6),(7) to sealing edge 1*c*: 1.6 cm;

Wall loading: 6.3 W/cm$^2$;

Suitable amounts of argon (for starting) and mercury were filled. to be a designed lamp voltage of 150 V.

The arc tube (3) was held in an outer tube (1) in which nitrogen gas was filled at 100 Torr and on an inner wall of which a phosphor layer was formed to prepare a 700 W fluorescent high pressure mercury vapor discharge lamp.

The discharge lamp was actuated by a 200 V lag type ballast for 700 W discharge lamp whereby all of mercury in the arc lamp was vaporized to give a lamp voltage of 150 V and a lamp power was 651 W.

The lamp power reduced percent was $6.3\% = (695-651)/695 \times 100\%$.

The lamp power of 6.3% could be reduced by actuating the discharge lamp with the 200 V lag type ballast for 700 W.

A total luminous flux of the discharge lamp was 41,700 lm which was substantially the same with the total luminous flux of the 700 W conventional discharge lamp of 42,000 lm. The combined effeciency was improved for 12.2% in comparison with the 700 W conventional discharge lamp.

EXAMPLE 5

Arc tube (3)

Inner diameter D: 2.75 cm;

Separation between electrodes (6),(7) 1*a*: 12 cm;

Separation between edge of electrode (6),(7) to sealing edge 1*c*: 1.6 cm;

Wall loading: 6.8 W/cm$^2$

Suitable amount of argon (for starting) and mercury were filled to be a designed lamp voltage of 150 V.

The arc tube (3) was held in an outer tube (1) in which nitrogen gas was filled at 100 Torr and on an inner wall of which a phosphor layer was formed to prepare a 1,000 W fluorescent high pressure mercury vapor discharge lamp.

The discharge lamp was actuated by a 200 V lag type ballast for 1,000 W discharge lamp whereby all of mercury in the arc lamp was vaporized to give a lamp voltage of 150 V and a lamp power was 928 W.

The lamp power reduced percent was $6.3\% = (990-928)/990 \times 100\%$.

The lamp power of 6.3% could be reduced by actuating the discharge lamp with the 200 V lag type ballast for 1,000 W.

A total luminous flux of the discharge lamp was 63,100 lm which was superior to the total luminous flux of the 1,000 W conventional discharge lamp of 61,000 lm. The combined efficiency was improved for 16.9% in comparison with the 1,000 W conventional discharge lamp.

The characteristics of the fluorescent high pressure mercury vapor discharge lamps of Examples 1 to 5 and the conventional fluorescent high pressure mercury vapor discharge lamps as references are shown in Table 2(a),(b).

TABLE 2 (a)

| Fluorescent high pressure mercury vapor discharge lamp | 400 W Conven. | 400 W Exp. 1 | 250 W Conven. | 250 W Exp. 2 | 300 W Conven. | 300 W Exp. 3 | 700 W Conven. | 700 W Exp. 4 | 1000 W Conven. | 1000 W Exp. 5 |
|---|---|---|---|---|---|---|---|---|---|---|
| Rated lamp power (W) | 400 | 400 | 250 | 250 | 300 | 300 | 700 | 700 | 1000 | 1000 |
| Shape of active tube | | | | | | | | | | |
| D (cm) | 1.95 | 1.95 | 1.55 | 1.55 | 1.75 | 1.75 | 2.25 | 2.25 | 2.75 | 2.75 |
| $l_a$ (cm) | 7.0 | 6.0 | 5.5 | 5.0 | 6.0 | 5.5 | 11.0 | 10.0 | 14.0 | 12.0 |
| $l_c$ (cm) | 1.25 | 1.2 | 1.0 | 1.0 | 1.0 | 1.0 | 1.65 | 1.6 | 1.65 | 1.6 |
| Wall loading (W/cm$^2$) | 6.4 | 6.6 | 6.3 | 6.2 | 6.5 | 6.4 | 6.3 | 6.3 | 6.4 | 6.8 |
| $N_2$ pressure in outer tube (Torr) | 580 | 100 | 580 | 100 | 580 | 100 | 580 | 100 | 580 | 100 |
| Lamp voltage (V) | 130 | 150 | 130 | 150 | 130 | 150 | 130 | 150 | 130 | 150 |

TABLE 2 (b)

| Fluorescent high pressure mercury vapor discharge lamp | 400 W Conven. | 400 W Exp. 1 | 250 W Conven. | 250 W Exp. | 300 W Conven. | 300 W Exp. 3 | 700 W Conven. | 700 W Exp. 4 | 1000 W Conven. | 1000 W Exp. 5 |
|---|---|---|---|---|---|---|---|---|---|---|
| Ballast input power (W) | 436 | 384 | 276 | 247 | 331 | 296 | 755 | 668 | 1076 | 952 |
| Ballast input power reduced percent (%) | 0 | 11.9 | 0 | 10.5 | 0 | 10.6 | 0 | 11.5 | 0 | 11.5 |
| Lamp power (W) | 397 | 361 | 247 | 230 | 296 | 276 | 695 | 651 | 990 | 928 |
| Lamp power reduced percent (%) | 0 | 9.1 | 0 | 6.9 | 0 | 6.8 | 0 | 6.3 | 0 | 6.3 |
| Total luminous flux (lm) | 23800 | 21700 | 13700 | 13100 | 17100 | 16000 | 42000 | 41700 | 61000 | 63100 |
| Total luminous flux variation percent (%) | 0 | −8.8 | 0 | −4.4 | 0 | −6.4 | 0 | −0.7 | 0 | +3.4 |
| Lamp efficiency (lm/W) | 59.9 | 60.1 | 55.5 | 57.0 | 57.8 | 58.0 | 60.4 | 64.1 | 61.6 | 68.0 |
| Combined efficiency (lm/W) | 54.6 | 56.5 | 49.6 | 53.0 | 51.7 | 54.1 | 55.6 | 62.4 | 56.7 | 66.3 |
| Combined efficiency variation | | | | | | | | | | |

TABLE 2 (b)-continued

| Fluorescent high pressure mercury vapor discharge lamp | 400 W Conven. | 400 W Exp. 1 | 250 W Conven. | 250 W Exp. | 300 W Conven. | 300 W Exp. 3 | 700 W Conven. | 700 W Exp. 4 | 1000 W Conven. | 1000 W Exp. 5 |
|---|---|---|---|---|---|---|---|---|---|---|
| percent (%) | 0 | +5.3 | 0 | +6.9 | 0 | +4.6 | 0 | +12.2 | 0 | +16.9 |

In Table 2(a), the tube wall load is given by input power/total inner surface area of arc tube.

In Table 2(b), the lamp efficiency is given by total luminous flux/lamp power and the combined efficiency is given by total luminous flux/ballast input power.

The other examples of the present invention will be illustrated.

Figure 3:
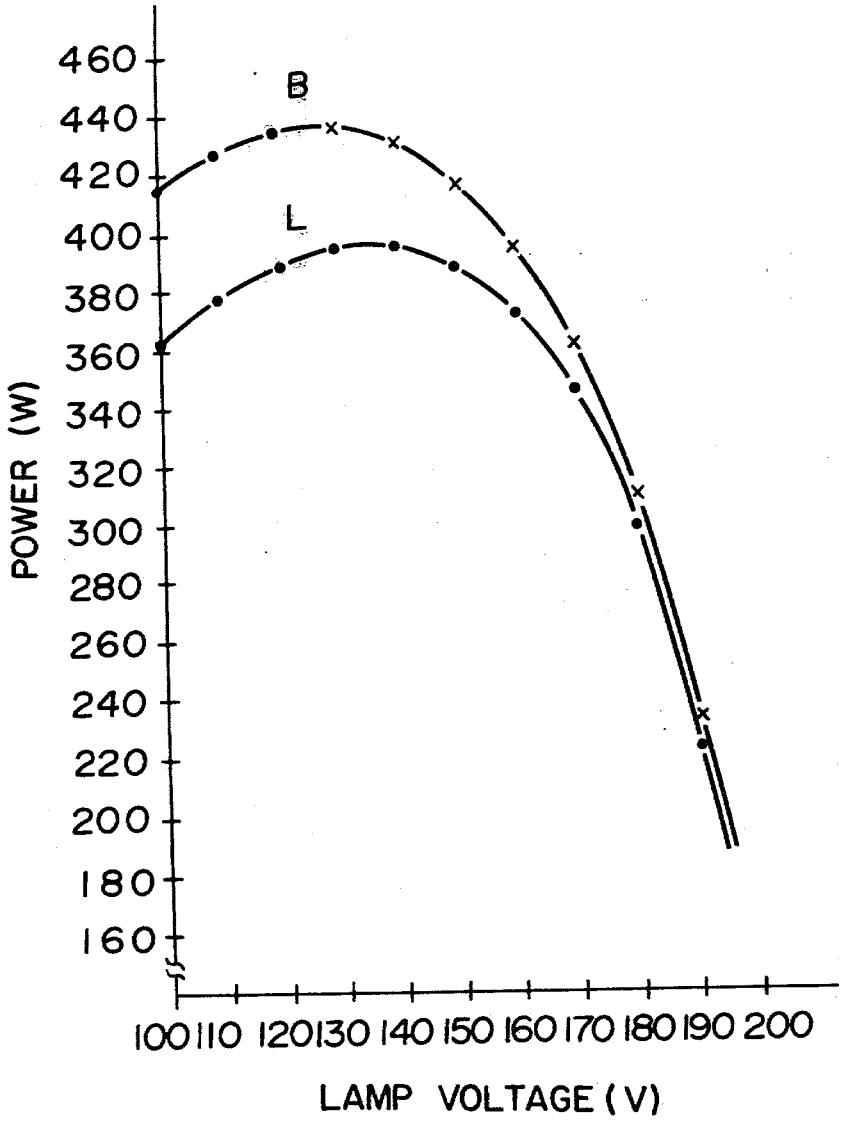
FIG. 3 is a characteristic diagram of powers of 400 W high pressure mercury vapor discharge lamps having various lamp voltages actuated by a 220 V lag type ballast.

FIG. 3 is a characteristic diagram for illustrating the principle of the other examples 400 W fluorescent high pressure mercury vapor discharge lamps having various lamp voltages which have the structure of Example 1 were prepared and these discharge lamps were actuated by a 220 V lag type ballast for 400 W discharge lamp and lamp voltages, lamp powers and ballast input powers were measured and the characteristic curves are shown in FIG. 3, wherein the curve L shows the lamp powers and the curve B shows the ballast input powers.

As it is clear from FIG. 3, the lamp power L and the ballast input power B are increased depending upon the increase of the lamp voltage. The lamp power L and the ballast input power B are maximum at the lamp voltage of about 130 V and they are decreased by increasing the lamp voltage over 130 V.

In the 400 W conventional fluorescent high pressure mercury vapor discharge lamp, the rated lamp voltage was 130 V. As it is shown in FIG. 3, the lamp power L was 395 W and the ballast input power B was 437 W at the lamp voltage of 130 V. The consumed power of the ballast was a difference between the ballast input power B and the lamp power L and it is 42 W=(437 W−395 W) at the rated lamp voltage of 130 V.

When the lamp voltage is higher than the rated lamp voltage of 130 V for the conventional high pressure mercury vapor discharge lamp, ballast input powers, ballast input power reduced percents, lamp powers, lamp power reduced percents and ballast consumed powers were measured. The results are shown in Table 3.

TABLE 3

| | Input side | | Lamp side | | |
|---|---|---|---|---|---|
| Lamp voltage (V) | Ballast input power (W) | Ballast input power reduced percent (%) | Lamp power (W) | Lamp power reduced percent (%) | Ballast consumed power (W) |
| 130 | 437 | 0 | 395 | 0 | 42 |
| 140 | 431 | 1.4 | 395 | 0 | 36 |
| 150 | 416 | 4.8 | 387 | 3.0 | 29 |
| 160 | 394 | 9.8 | 372 | 5.8 | 22 |
| 170 | 360 | 17.6 | 346 | 12.4 | 14 |
| 180 | 309 | 29.3 | 299 | 24.3 | 10 |
| 190 | 233 | 46.7 | 224 | 43.3 | 9 |

As it is clear from Table 3 and FIG. 3, the ballaster input power and the lamp power are remarkably decreased and the ballaster consumed power is also decreased depending upon the increase of the lamp voltage.

The 400 W conventional high pressure mercury vapor discharge lamp has a rated lamp voltage of 130 V, however the discharge lamps having a lamp voltage of about 120 to 140 V have been used from the viewpoint of quality control in a production.

In these examples, high pressure mercury vapor discharge lamps having a lamp voltage of higher than 150 V and lower than 200 V are used in order to attain power saving effects from various viewpoints.

When the lamp voltage is lower than 150 V, satisfactory power saving effect could not be obtained whereas when the lamp voltage is higher than 200 V, the voltage applied to the lamp is similar to the lamp voltage whereby the discharge becomes unstable to cause easily extinction of the lamp. Therefore, in order to obtain excellent power saving effect and to maintain stable discharge, the range of the lamp voltages in the examples is in the range of 150 to 200 V.

The other examples of the present invention will be further illustrated.

EXAMPLE 6

Arc tube (3)

Inner diameter D 1.95 cm;

Separation between electrodes (6),(7) 1*a*: 6 cm;

Separation between edge of electrodes (6),(7) to sealing edge 1*c*: 1.2 cm;

Wall loading: 6.8 W/cm$^2$

Suitable amounts of argon (for starting) and mercury were filled to be a designed lamp voltage of 160 V.

The arc tube (3) was held in an outer tube (1) in which nitrogen gas was filled at 100 Torr and on an inner wall of which a phosphor layer was formed to prepare a 400 W fluorescent high pressure mercury vapor discharge lamp. The discharge lamp was actuated by a 220 V lag type ballast for 400 W discharge lamp whereby all of mercury in the arc tube was vaporized to give a lamp voltage of 160 V and a lamp power was 372 W.

The lamp power reduced percent was 5.8%=(395−372)/395×100%.

The lamp power of 5.8% could be reduced by actuating the discharge lamp with the 220 V lag type ballast for 400 W.

A total luminous flux of the discharge lamp was 22,400 lm which was substantially the same with the total luminous flux of the 400 W conventional discharge lamp of 23,700 lm. The combined efficiency was improved for 5.0% in comparison with the 400 W conventional discharge lamp.

The characteristics of the discharge lamp of Example 6 and the conventional discharge lamp as reference are shown in Table 4(a),(b).

TABLE 4 (a)

| Fluorescent high pressure mercury vapor discharge lamp | 400 W Conven. | 400 W Exp. 6 |
|---|---|---|
| Rated lamp power (W) | 400 | 400 |
| Shape of active tube | | |
| D (cm) | 1.95 | 1.95 |
| $l_a$ (cm) | 7.0 | 6.0 |
| $l_c$ (cm) | 1.25 | 1.2 |
| Wall loading (W/cm$^2$) | 6.4 | 6.8 |

TABLE 4 (a)-continued

| Fluorescent high pressure mercury vapor discharge lamp | 400 W Conven. | 400 W Exp. 6 |
|---|---|---|
| $N_2$ pressure in outer tube (Torr) | 580 | 100 |
| Lamp voltage (V) | 130 | 160 |

TABLE 4 (b)

| Fluorescent high pressure mercury vapor discharge lamp | 400 W Conven. | 400 W Exp. 6 |
|---|---|---|
| Ballast input power (W) | 437 | 394 |
| Ballast input power reduced percent (%) | 0 | 9.8 |
| Lamp power (W) | 395 | 372 |
| Lamp power reduced percent (%) | 0 | 5.8 |
| Total luminous flux (lm) | 23700 | 22400 |
| Total luminous flux variation percent (%) | 0 | −5.5 |
| Lamp efficiency (lm/W) | 60.0 | 60.2 |
| Combined efficiency (lm/W) | 54.2 | 56.9 |
| Combined efficiency variation percent (%) | 0 | +5.0 |

In the example, the fluorescent high pressure mercury vapor lamps have been illustrated. However, the concept of the present invention can be also applied for the higher pressure metal vapor discharge lamps such as high pressure mercury vapor discharge lamp, metal halide discharge lamp and high pressure sodium vapor discharge lamp.

The atmosphere in the outer tube (1) is preferably vacuum or an inert gas such as nitrogen gas at lower than 200 Torr. When the pressure of the inert gas is higher than 200 Torr. sometimes, the temperature of the arc tube (3) is not reached to a predetermined degree by the cooling effect of the inert gas, whereby the designed lamp voltage is not given.

What is claimed is:

1. A lighting equipment which comprises a high pressure metal vapor discharge lamp having a rated operating lamp voltage of 145 to 180 V which is actuated by a lag type ballast supplied with a voltage of lower than 220 V.

2. A lighting equipment which comprises a high pressure metal vapor discharge lamp having a rated operating lamp voltage of 150 to 200 V which is actuated by a lag type ballast supplied with a voltage of approximately 220 V.

* * * * *